United States Patent [19]

Kletecka et al.

[11] Patent Number: 5,047,460

[45] Date of Patent: Sep. 10, 1991

[54] STABILIZED POLYPROPYLENE FIBERS PIGMENTED WITH RED 144

[75] Inventors: George Kletecka, Fairview Park; John Ta-Yuan Lai, Broadview Heights, both of Ohio

[73] Assignee: The BFGoodrich Company, Akron, Ohio

[21] Appl. No.: 352,519

[22] Filed: May 16, 1989

[51] Int. Cl.[5] ..... C08K 5/34

[52] U.S. Cl. ..... 524/100; 524/190; 524/579; 524/583

[58] Field of Search ..... 524/96, 100, 190

[56] References Cited

U.S. PATENT DOCUMENTS

| | | | |
|---|---|---|---|
| 4,185,004 | 1/1980 | Mathis | 524/101 |
| 4,780,495 | 11/1988 | Lai et al. | 524/100 |
| 4,797,438 | 1/1989 | Kletecka et al. | 524/100 |

OTHER PUBLICATIONS

"Influence of Pigments on the Light Stability of Polymers: A Critical Review", by Peter P. Klemchuk, *Polymer Photochemistry,* 3 (1983).

"Stabilization of PP Fibers", by Marvin Wishman, Phillips Fiber Corporation, Greenville, S.C.

"Influence of Pigments on the Degradation of Polypropylene Fibers on Exposure to Light and Weather", by Steinlin, Felix and Saar, W., paper presented at 19th Intl. Manmade Fiber Conf., 09/25/80, Dornbirn-/Austria.

*Primary Examiner*—Joseph L. Schofer

*Assistant Examiner*—Mark Sweet

*Attorney, Agent, or Firm*—Alfred D. Lobo

[57] ABSTRACT

Excellent stabilization to bright sunlight, is obtained in polypropylene (PP) fibers pigmented with Red 144, by combining the pigment with N-(substituted)-1-(piperazin-2-one alkyl)-α-(3,5-dialkyl-4-hydroxyphenyl)-α,α-substituted acetamide ("3,5-DHPZNA" for brevity). Stabilization of the red color is obtained for as long as the PP fibers themselves are stabilized by the 3,5-DHPZNA. 3,5-DHPZNA is a known hybrid stabilizer having a hindered amine N-(substituted)-1-(piperazin-2-one alkyl) group at one end, and a hindered phenol (3,5-dialkyl-4-hydroxyphenyl) group at the other. This particular hybrid, containing a piperazinone group, combined through a disubstituted alpha carbon atom of the acetamide in a single molecule, affords the advantages of each group with respect to its stabilization of the fiber against degradation, but without the expected adverse interaction of each group with Red 144 pigment. With 3,5-DHPZNA and Red 144 pigment, essentially no secondary stabilizer is necessary. Red PP fibers so stabilized, exhibit an acceptably low level of discoloration (color fading) due to degradation of the pigment, over the useful life of the PP fibers. When exposed to sunlight for 6 months in Florida at a 45° South exposure, the red PP fibers suffer essentially no loss of color due to degradation of the pigment. Retention of red color in articles exposed to sunlight over their useful life, is of great practical value in clothing and household goods made from woven or non-woven fabrics of Red 144-pigmented PP fibers.

4 Claims, 4 Drawing Sheets

STABILIZED POLYPROPYLENE FIBERS PIGMENTED WITH RED 144

BACKGROUND OF THE INVENTION

This invention relates to the stabilization of fibers of polypropylene or predominantly propylene-containing copolymers (together referred to hereafter as "PP fibers" for brevity) colored with a specific pigment namely Red 144 (common name). It is known that several stabilizers, particularly hindered amine light stabilizers ("HALS"), provide excellent stabilization of the PP fibers, but not to the red coloration of Red 144-pigmented PP fibers. These pigmented PP fibers lose their pigmentation, due to chemical degradation of the pigment, long before the fibers themselves are degraded past the point where they serve their intended use. The problem is exacerbated because increasing the concentration of Red 144 pigment in the fibers accelerates their degradation.

Red 144 (referred to as such for brevity and convenience) is an azo condensation pigment, more correctly identified as [2-napahthalenecarboxamide, N,N'-(2-chloro-p-phenylene)bis[4-[2,5-dichlorophenyl)azo]-3-hydroxy (reg. no. 5280-78-4), available as the commercial product Cromophtal Red BRN, from Ciba-Geigy, and Red BR PR144/45415 from Ampacet.

Commercially available PP fibers today have good resilience and heat stability, and have successfully been stabilized against ultraviolet (uv) light degradation with a wide spectrum of HALS. But such stabilized PP fibers have poor dyeability because PP is essentially unreactive with most dyes. This poor dyeability of PP dictates that PP fibers must be pigmented for long-term stability of PP fibers colored with many popular colors. With particular respect to red PP fibers which are in high demand, an effective red pigment now in use is Red 144. The problem is that the use of Red 144, both hastens the degradation of the PP fibers when exposed to sunlight, and degrades their physical properties over time, so that combined, the fibers are subjected to a two-pronged attack on their longevity in normal use, thus vitiating their marketability.

Fabrics made from Red 144 pigmented PP fibers are especially popular in automobiles, boats, outdoor clothing, and other such uses where the fibers degrade at such an unacceptably high rate upon exposure to sunlight, that they are soon transformed into nonuniformly colored articles sporting a wide spectrum of shades of pink and orange. The obvious way to cope with this color degradation problem is to use far more pigment than is required to provide the desired color, so that upon suffering the expected color degradation, the coloration of the remaining non-degraded pigment will maintain acceptable, if not the original, color. Except that 'loading up' the HALS-stabilized fibers with more Red 144 pigment to maintain tinctorial strength, simply accelerates degradation of the PP fibers because Red 144 has a high proclivity towards reaction with commonly used HALS, and other additives such as antioxidants and antiozonants, used to provide melt-stability to the PP.

Typically, several additives are combined in PP before it is melt extruded into fiber, each additive specifically designed to provide a different zone of stabilization, the main zones being (a) melt extrusion stability, (b) long term thermal stability during conditions expected to be encountered during use, (c) uv light stability in bright, direct sunlight, and by no means of least importance, (d) stable tinctorial strength to maintain the desired color. Combining several additives known to be effective for each specific purpose, in PP fibers particularly, is likely not to produce the desired results because of objectionable side effects due to interaction between the additives.

For example, thiodipropionate compounds such as dilauryl (DLTDP) and distearyl (DSTDP) help control melt-stability despite an odor problem, and certain phosphites control melt flow while depressing the tendency of PP fibers to yellow because the fibers usually contain a hindered phenol antioxidant. The hindered phenol antioxidant increases long term stability but accelerates yellowing. It is known that a hindered phenol antioxidant and a thiodipropionate are most effective when used together. Certain HALS provide not only excellent uv stability but also such good long term thermal stability that the PP fibers will outlast some of the pigments used to color them. Therefore a HALS is combined with a hindered phenol antioxidant and a phosphite.

Pigments are selected with an eye to their effect on the processing of the PP fibers, the stability requirements of the end product, the pigment's interaction with the other additives to be used, the color requirements, and the cost of producing the pigmented PP fibers. The intense thrust towards using inexpensive PP fibers in the automobile industry where the color red is in high demand decreed that, despite its high cost, Red 144 be used, because of its intense tinctorial strength and color stability; and, that Red 144 be combined with a compatible uv stabilizer. It was found that the most damaging factor in the stability of Red 144-pigmented PP fibers was their interaction with the hindered amine uv stabilizers used.

The commercial use of red PP fibers requires that the color stability of the PP fiber be such that it equals the useful life of a fabric or other article containing the fiber, which article is exposed to heat and light. Because the stabilizers used generally affect color, though they are not regarded as colorants, and pigments may affect thermal and uv light stability even if they are not known to have such activity, one cannot estimate what the net effect of the interactions might be. (see "Influence of Pigments on the Light Stability of Polymers: A Critical Review" by Peter P. Klemchuk, *Polymer Photochemistry* 3 pg 1-27, 1983).

We continued our tests with numerous combinations of stabilizers in Red 144-pigmented fibers, screening the samples to determine whether an unacceptable level of color loss was obtained before the fibers disintegrated. We measured the degree of degradation of the pigmented fibers both by visual observation, and by "scratch testing" (described herebelow) the surfaces of exposed fibers.

Fiber degradation is a phenomenon which is easily visible to the naked eye upon inspection of a degrading pigmented yarn exposed either in a Weather-O-Meter in presence of moisture, or, to bright sun (tests are conducted in the Florida sun) under ambient conditions of humidity. Unstabilized Red 114-pigmented PP fibers exposed to the Florida sun show no fading because the pigmented fibers degrade far more rapidly than the pigment, which results in continual sloughing off of layers of fiber exposing bright undegraded pigment. Degradation of stabilized PP fibers is characterized (i)

by a fuzzy, peach-skin-like appearance of the surface of the fabric (made with the pigmented fibers), and (ii) the problem of fading color.

Of particular interest is the peculiar uv-stabilization effect of N-(substituted) α-(3,5-dialkyl-4-hydroxyphenyl)-α,α-disubstituted acetamides in which one of the substituents on the N atom is a 2-piperazinone group. More correctly, the compounds are "N-(substituted)-1-(piperazin-2-one alkyl)- c -(3,5-dialkyl-4-hydroxyphenyl)-α,α-substituted acetamides", which are hereinafter referred to as "3,5-DHPZNA" for brevity. This 3,5-DHPZNA stabilizer is disclosed in U.S. Pat. No. 4,780,495 to John T. Lai, for its uv-light stabilization in PP, and, because of the presence of a polysubstituted piperazinone (PSP) group in the molecule, was routinely tested in PP plaques for such stabilization-effectiveness as 3,5-DHPZNA might have. Since the majority of PP articles are extruded or molded shapes other than fibers, most testing for stabilization is conventionally done with plaques, not fibers, because plaques are more conveniently prepared. The plaques deteriorated rapidly. Only by chance was 3,5-DHPZNA also tested in Red 144-pigmented PP fibers, and its remarkable effectiveness noted.

As one would expect, some pigments enhance heat and light stability of PP fibers stabilized with a particular antioxidant and hindered amine stabilizer. Other pigments have the opposite effect. Until tested, one cannot predict with reasonable certainty, what the effect will be. For example, with a nickel-containing stabilizer, Red 101 (iron oxide) is a prodegradant. With the more effective hindered amine stabilizers, both Yellow 93 and Red 144 are prodegradants. The effect of these pigments in stabilized PP fibers could not have ben predicted by their behavior in unstabilized pigmented fibers, or by their behavior with a different stabilizer. With a nickel-containing stabilizer, Red 144 (unlike Red 101) is a stabilizer (not a prodegradant), but Red 144 is a prodegradant with Tinuvin 770. Yellow 93, a stabilizer when no other stabilizer is present, is neutral with nickel stabilization but is a prodegradant with Tinuvin 770 (see "Stabilization of Polypropylene Fibers" by Marvin Wishman of Phillips Fibers Corporation). Specifically with respect to red PP fibers, the problem was to find a combination of stabilizers which circumvented the proclivity of Red 144 to degrade the PP fibers when the pigment is combined with a conventional AO and uv light stabilizer. Because Red 144 was a prodegradant it seemed desirable to use only as much of it as would provide the desired tinctorial effect for the required period of time, namely the useful life of the stabilized PP fiber.

The effect of a large number of pigments on the stability of PP fibers stabilized with Tinuvin 770 has been reported by Steinlin and Saar (see "Influence of Pigments on the Degradation of Polypropylene Fibers on Exposure to Light and Weather", paper presented at the 19th International Manmade Fiber Conference, September 1980 in Austria).

In the same vein, like other workers before us, we tested a large number of combinations with Red 144, and tested them in fibers. We confirmed that Tinuvin 144 in combination with Red 144, stabilizes fiber but does not stabilize the red color, acting more like a prodegradant for color stability. Tinuvin 144 is a HALS molecule of comparable size to that of 3,5-DHPZNA, and like 3,5-DHPZNA is a hybrid molecule. Tinuvin 144 combines a hindered phenol with a substituted piperidyl rather than with a substituted piperazinone. But this combination of hindered phenol and piperidyl groups in one molecule is not as effective with Red 144 as the combination of hindered phenol and piperazinone. Chimassorb 944 provides excellent stabilization to Red 144-pigmented PP fibers, but Chimassorb 944, like Tinuvin 144, provide excellent uv stabilization only of the PP, not the color, which degrades rapidly. With Tinuvin 770, there is greater negative interaction than with Tinuvin 144 as evidenced by decreased stability of the PP.

Generally, if a stabilizer is effective in fibers it is effective in plaques, but the opposite is not true. Red 144-pigmented PP fibers are stabilized with 3,5-DHPZNA against heat and light and it is reasonable to expect a comparable effect in Red 144-pigmented PP plaques. Moreover, 3,5-DHPZNA-stabilized PP fibers pigmented with Red 144 do not require the added presence of a conventional hindered phenol antioxidant, though a small amount up to about 0.1 phr, may be used to provide a high level of melt-stability when the Red 144-pigmented PP is extruded from a spinneret.

U.S. Pat. No. 4,797,438 to Kletecka et al discloses that hindered amines with a specific structure known to exhibit excellent uv stabilization in numerous host polymers without notably distinguishing one polymer from another as far as their relative susceptibility to uv stabilization is concerned, are surprisingly effective to stabilize PP against degradation by gamma-radiation. Moreover, such stabilization extends to articles of arbitrary shape, including fibers, and these amines are more effective when used without an AO, phosphite or thioester. It was not known, however, nor could we reasonably predict, what the interaction of the 3,5-DHPZNA stabilizer in particular, would be with Red 144 pigment.

The peculiarly distinguishing structural feature of the stabilizers in the '438 Kletecka et al composition, is that they, like 3,5-DHPZNA, contain as an essential portion of their basic structure, a PSP having an $N^1$-adjacent carbonyl in the PSP group, and at least the $C^3$ (carbon atom in the 3-position in the ring) has two substituents (hence "polysubstituted or substituted"), which may be cyclizable, that is, form a cyclic substituent. But unlike 3,5-DHPZNA, those stabilizers do not contain a hindered phenol group in the same molecule.

Though 3,5-DHPZNA compounds referred to in the aforementioned '495 Lai patent were known to be excellent UV stabilizers in colorless organic materials when used in combination with antioxidants, there was nothing to suggest that its incorporation in PP fibers, alone among other polymers tested, in the presence of less than 0.1 phr of each of a conventional hindered phenol antioxidant and phosphite which provide melt-stabilization, would provide effective stabilization against discoloration of Red 144 pigment.

SUMMARY OF THE INVENTION

It has been discovered that N-(substituted)-1-(piperazin-2-one alkyl)-α-(3,5-dialkyl-4-hydroxyphenyl)-α,α-disubstituted acetamide, namely 3,5-DHPZNA, having a N-(substituted)-1-(piperazine-2-one alkyl) group at one end and a (3,5-dialkyl-4-hydroxyphenyl)-α,α-disubstituted acetamide at the other, provides a hybrid stabilizer for Red 144-pigmented PP fiber. The 3,5-DHPZNA combines a hindered amine with a hindered phenol through a disubstituted alpha carbon atom of the acetamide in a single molecule. When this hybrid is incorporated into PP fibers pigmented with Red 144 pigment, the hybrid affords the advantages of each group and minimizes the discoloration typically generated by interaction of two or more stabilizers each containing one of the groups of the hybrid; further, woven or non-woven articles made from Red 144pigmented PP fibers stabilized with such a hybrid, have improved strength and discoloration resistance, compared to that of articles made from identically pigmented PP fibers stabilized with several other commercially available hindered amines tested by exposing the articles similarly exposed to infrared, visible and actinic radiation.

It has also been discovered that 3,5-DHPZNA in Red 144-pigmented PP fibers, stabilizes the discoloration attributable to degradation of the pigment in the PP fibers, when the fibers are exposed to bright sunlight for 6 months at 45° South (exposure) in the Florida sun, if the 3,5-DHPZNA is used in an amount in the range from about 0.1 phr to 5 phr, and the Red 144 pigment is used in as small an amount as in the range from about 0.1 phr to about 1 phr in PP fibers.

It is therefore a general object of this invention to provide Red 144-pigmented PP fibers which have been stabilized against exposure to sunlight, with an effective amount of the 3,5-DHPZNA stabilizer sufficient to stabilize the fibers so that, after exposure to bright sunlight for 6 months at 45° South, they exhibit essentially no fading of the red pigment and essentially no polymer degradation.

It is also a general object of this invention to provide a method for imparting improved strength and discoloration resistance to stabilized, Red 144-pigmented PP fibers, which method comprises incorporating into PP fibers only as much of a conventional hindered phenol or phosphite antioxidant, no more than 0.1 phr, as is desired for melt-stabilization of the fiber, and, an effective amount of the 3,5-DHPZNA in combination with Red 144 pigment, said amount being sufficient to decelerate discoloration of the red PP fibers, as evidenced by color fading during the useful life of an article made with the red fibers.

It is a specific object of this invention to provide a method for stabilizing articles made from Red 144-pigmented woven and non-woven PP fibers, which method comprises, exposing said Red 144-pigmented PP fibers to bright sunlight for 6 months at 45° South, without fading of the pigment; said PP fibers being essentially free of both a phosphite and a hindered phenol antioxidant, but the fibers having incorporated therein (i) from 20 parts per million (ppm) to about 1 phr, preferably from 0.1 to 0.8 phr, of Red 144; and (ii) from 20 parts per million (ppm) to about 2.0%, preferably from 0.1% to 0.5%, of 3,5-DHPZNA, based upon the weight of the PP in the fibers.

It is another general object of this invention to provide woven, non-woven and other fabricated articles, made from Red 144-pigmented PP fibers and subjected to bright sunlight for the useful life of the articles, with improved strength and discoloration resistance, provided the PP fibers have incorporated therein a 3,5-DHPZNA stabilizer, in an effective amount, sufficient to decelerate oxidative degradation of the PP fibers.

BRIEF DESCRIPTION OF THE DRAWINGS

The foregoing and other objects and advantages of my invention will appear more fully from the following description, made in connection with the accompanying graphs which illustrate the result-effectiveness of the combination of 3,5-DHPZNA and Red 144 pigment in PP fibers essentially free of a secondary stabilizer, that is, having no more than 0.1 phr of each melt-stabilizing antioxidant such as a conventional hindered phenol and phosphite.

DETAILED DESCRIPTION OF PREFERRED EMBODIMENTS

In a particular embodiment, this invention provides an article made from a woven or non-woven fabric of Red 144-pigmented PP fibers. Woven fabrics are produced from yarn by any one of several weaving techniques. Non-woven fabrics of PP may have a carded fiber structure or comprise a mat in which the fibers or filaments are distributed in a random array. The fibers may be bonded with a bonding agent such as a polymer, or the fibers may be thermally bonded without a bonding agent. The fabric may be formed by any one of numerous known processes including hydroentanglement or spun-lace techniques, or by air laying or melt-blowing filaments, batt drawing, stitchbonding, etc. depending upon the end use of the article to be made from the fabric.

Incorporated in the PP, and preferably uniformly distributed in the PP melt before it is spun into filaments, is (i) a small amount, less than 2 phr of Red 144 pigment, preferably less than 1 phr, and typically from 0.05 phr to about 0.75 phr; (ii) no more than 0.1 phr each of a hindered phenol AO and a phosphite, required for melt-stabilization of the PP; and (iii) from about 20 ppm to about 2.0% by weight (based on the weight of all the polymer from which the article is formed), and more preferably from about 0.1 phr to about 1.0 phr, of a N-(substituted)-1-(piperazin-2-one alkyl)-α-(3,5-dialkyl-4-hydroxyphenyl)-α,α-substituted acetamide (3,5-DHPZNA). Details for preparation of numerous substituted acetamides having the 3,5-DHPZNA moiety are disclosed in the aforementioned '495 Lai patent, the disclosure of which is incorporated by reference thereto as if fully set forth herein.

Figure 4:
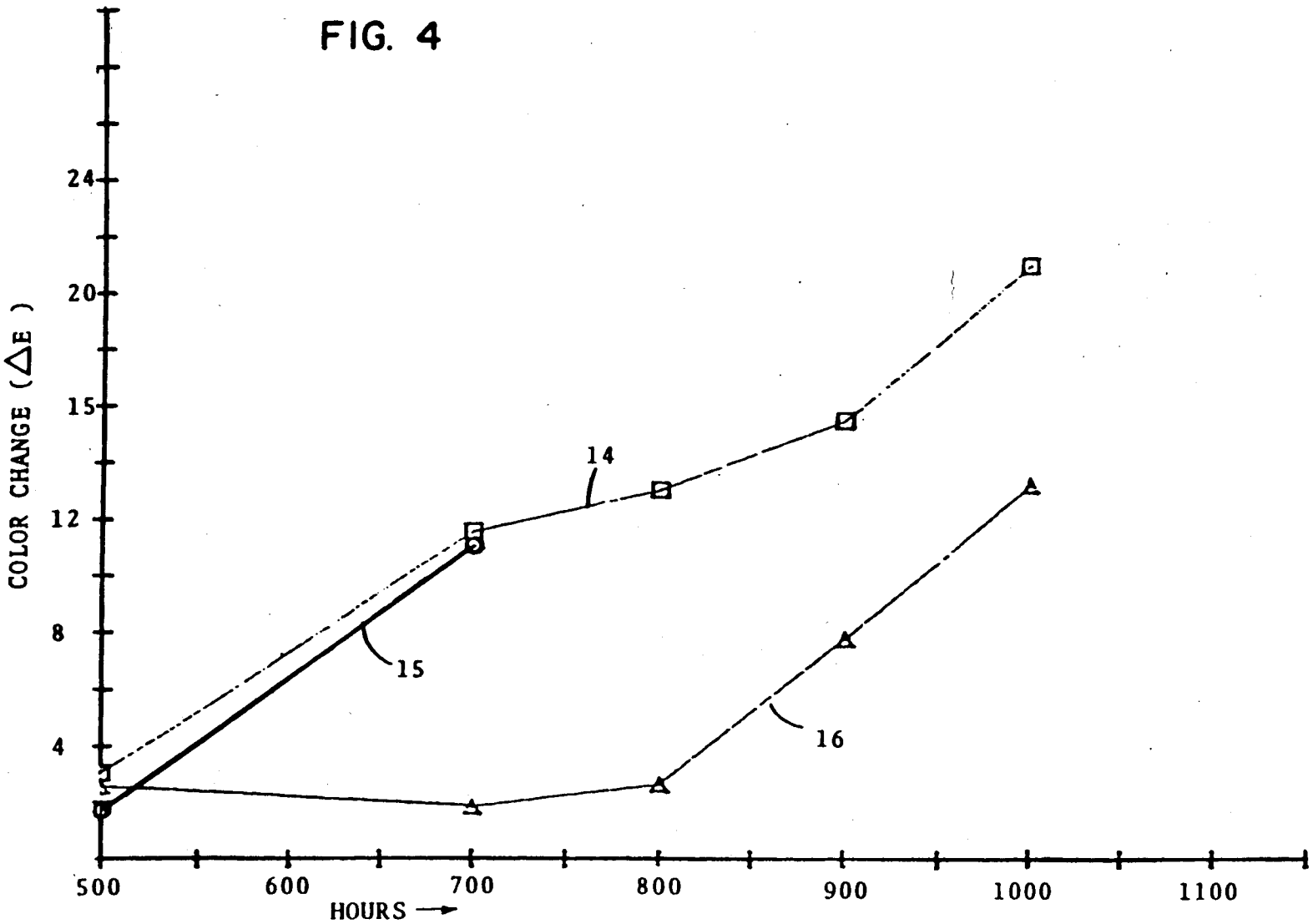
FIG. 4 presents three curves representing the color change (delta E) plotted as a function of time for Red 144-pigmented PP fibers containing different stabilizers.

As will presently be evident from data graphically presented in FIG. 4 which will be referred to herebelow, it is not sufficient to have a hindered phenol group in the molecule of an effective Red-144 color stabilizer, nor a substituted piperazinone or piperidyl group, nor an alpha carbon atom which is disubstituted; nor any combination of two of the foregoing groups. It is essential that a combination of each of three groups, namely the hindered phenol, the substituted pipearazinone, and the disubstituted alpha carbon atom, all be present in a single molecule, to provide the color stabilization for Red 144 pigment, and also the stabilization of the PP fibers against degradation; and, they are so present in the 3,5-DHPZNA molecule.

The 3,5-DHPZNA structure is found in a stabilizer which combines the foregoing groups in the same molecule, and acid addition salts of 3,5-DHPZNA which is represented by the structure:

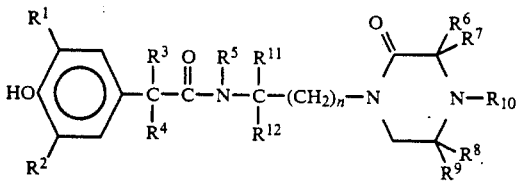

(1)

wherein, $R^1$, $R^2$ and $R^5$ each represent hydrogen, $C_1$–$C_{12}$ alkyl, phenyl, naphthyl, $C_4$-$C_{12}$ cycloalkyl, and, alkylsubstituted cycloalkyl, phenyl and naphthyl, each alkyl substituent being $C_1$–$C_8$, and at least one of $R^1$ and $R^2$ is t-$C_4$–$C_{12}$ alkyl;

$R^3$ and $R^4$ independently represent $C_1$–$C_{18}$ alkyl, and $C_5$–$C_{12}$ cycloalkyl, phenyl and naphthyl, and, alkyl-substituted cycloalkyl, phenyl and naphthyl, each alkyl substituent being $C_1$–$C_8$, and, when together cyclized, $R^3$ with $R^4$ may represent $C_4$-$C_{12}$ cycloalkyl, and $C_1$–$C_8$ alkyl-substituted cycloalkyl;

$R^6$, $R^7$, $R^8$ and $R^9$ each represent $C_1$–$C_{12}$ alkyl, or, when together cyclized, $R^6$ with $R^7$, and $R^8$ with $R^9$, may represent $C_4$–$C_{12}$ cycloalkyl, and $C_1$–$C_8$ alkyl-substituted cycloalkyl;

$R^{10}$ is selected from the group consisting of hydrogen, $C_1$–$C_8$ alkyl and

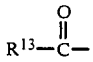

wherein $R^{13}$ represents hydrogen, $C_1$–$C_{18}$ alkyl or alkenyl, phenyl or naphthyl;

$R^{11}$ and $R^{12}$ independently represent hydrogen and $C_1$–$C_{18}$ alkyl; and, n is an integer in the range from 1 to about 8.

Specific examples of such 3,5-DHPZNA stabilizers are identified by the following code numbers and structures in which $CH_2$ groups at the intersection of lines are not otherwise identified, and projecting lines represent $CH_3$ groups.

The substituents on the alpha-C atom of the acetamide are critical in the above-identified stabilizer compound.

It will be appreciated that when $R^{10}$ is to be acyl, it is introduced by an acylation step after formation of the 3,5-DHPZNA in which there is no substituent on the $N^4$ atom of the diazacycloalkane ring.

The process for preparing the foregoing 3,5-DHPZNA compounds comprises reacting a 2,6-dialkylphenol with at least equimolar quantities of an aliphatic, cycloaliphatic or alkaryl ketone and a 4-amino-polysubstituted piperazine or 4-amino-polysubstituted piperazin-2-one in the presence of an alkali metal hydroxide, preferably at a temperature in the range from about −10° C. to about 50° C.

The 2,6-dialkylphenol reactant is represented by the structure

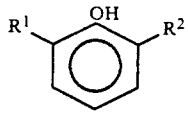

(2)

wherein $R^1$ and $R^2$ have the same connotations set forth hereinabove.

The 4-amino-polysubstituted piperazin-2-ones are N-substituted cyclic alkyleneimines represented by the structure

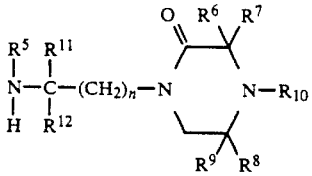

(3)

wherein $R^5$, $R^6$, $R^7$, $R^8$, $R^9$ and $R^{10}$ have the same connotation as that given hereinbefore. Two or more of the 4-amino-polysubstituted piperazinone moieties may be present on a single molecule, for example, when the moiety is a substituent in each of the two primary amine groups of an alkane diamine; or, of a triamine or tetramine.

The 3,5-DHPZNA is then produced by the ketoform reaction. As before, at least a stoichiometric amount of the 4-amino-polysubstituted piperazine is used, relative to the amount of 2,6-dialkylphenol, an excess of amine being preferred for good yields. Most preferred is up to a fourfold excess.

The ketone reactant may be a dialkylketone, a cycloalkanone, or alkylcycloalkanone, represented by the structure

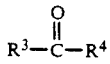

(3)

wherein, $R^3$ and $R^4$ are independently selected from $C_1$–$C_8$ alkyl.

The 3,5-DHPZNA product is readily isolated from the reaction mass by filtration, and washing the filtrate with aqueous inorganic acid, typically HCl or $H_2SO_4$. The filtrate is dried with a dessicant such as sodium sulfate, then heated to dryness. The product obtained may be recrystallized from a solvent if greater purity is desired. Additional details relating to the procedures for preparing and recovering the compounds are found in the aforementioned '495 Lai patent.

(1) N-isopropyl-N-[2-(2-keto-3,3,5,5-tetramethyl-1-piperazinyl) ethyl]-2-(3,5-di-t-butyl-4-hydroxyphenyl)-2-methyl propanamide represented by the structure

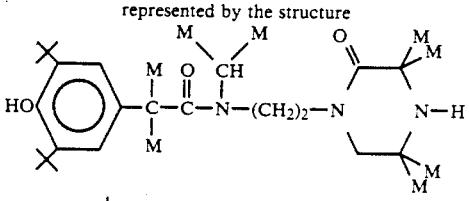

+ = t-butyl M = methyl (2) N-[1-(2-keto-3,3,5,5-tetramethyl-1-piperazinyl-2-methyl-2-propyl]-2-(3,5-di-t-butyl-4-hydroxyphenyl)-2-methyl-propanamide represented by the structure -continued

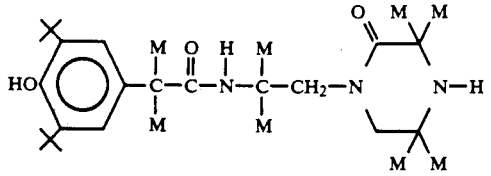

+ = t-butyl M = methyl "X-146"

(3) N-[1-(2-keto-3,5,5-trimethyl-3-ethyl-1-piperazinyl-2-methyl-2-propyl]-2-(3,5-di-t-butyl-4-hydroxyphenyl)-2-methyl-butanamide represented by the structure

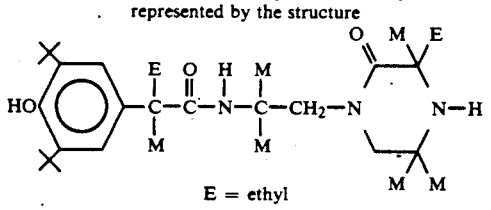

E = ethyl (4) N[1-(2-keto-3,3-pentamethylene-5,5-dimethyl-1-piperazinyl)-2-methyl-2-propyl]-2-(3,5-di-t-butyl-4-hydroxyphenyl)-2,2-pentamethylene acetamide represented by the structure

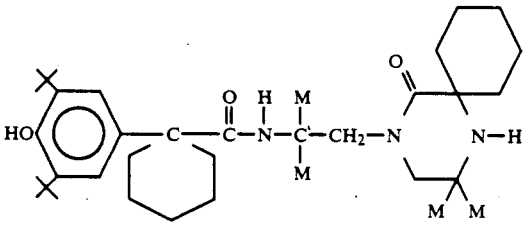

(5) N-[1-(2-keto-3,3,5,5-tetramethyl-1-piperazinyl-2-methyl 2-propyl]-2-(3,5-di-t-butyl-4-hydroxyphenyl)-2,2-pentamethylene acetamide represented by the structure

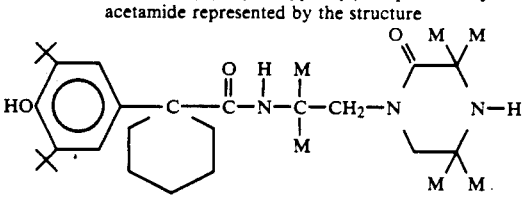

(6) N-cyclohexyl-N-[2-(2-keto-3,3,5,5-tetramethyl-1-piperazinyl ethyl]-2-(3,5-di-t-butyl-4-hydroxyphenyl)-2,2-pentamethylene acetamide represented by the structure

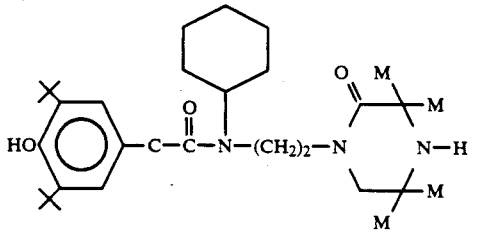

(7) N-cyclohexyl-N-[3-(2-keto-3,3,5,5-tetramethyl-1-piperazinyl propyl]-2-(3,5-di-t-butyl-4-hydroxyphenyl)-2,2-pentamethylene acetamide represented by the structure

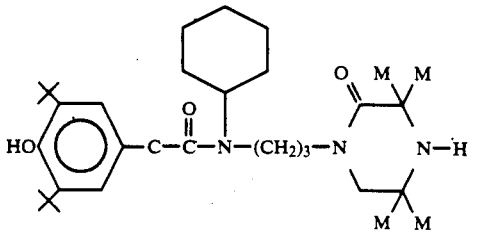

(8) N-cyclohexyl-N-[3-(2-keto-3,3,5,5-tetramethyl-1-piperazinyl-propyl]-2-(3,5-di-t-butyl-4-hydroxyphenyl)-2-methyl propanamide represented by the structure

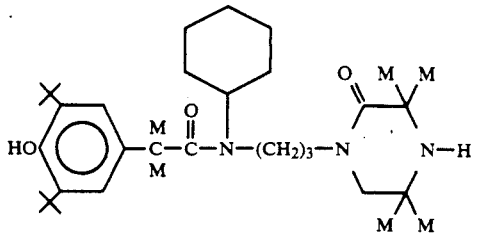

(9) N-cyclohexyl-N-[3-(2-keto-3,3,5,5-tetramethyl-1-piperazinyl-propyl]-2-(3,5-di-t-butyl-4-hydroxyphenyl)-2-methyl butanamide represented by the structure

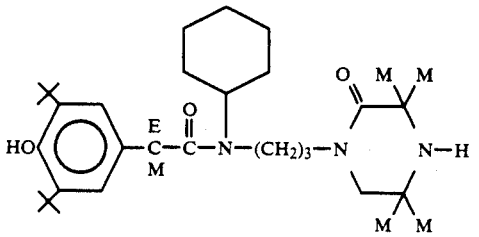

The propylene polymer is typically polypropylene homopolymer, but may be a random or block copolymer of propylene and a monoolenfinically unsaturated monomer X, (P-co-X) with up to about 30% by wt of X wherein X represents vinyl acetate, or a lower $C_1$–$C_4$ alkyl acrylate or methacrylate. Blends of such propylene polymers with other polymers such as polyethylene are also included within the scope of this invention. For convenience, homopolymer PP and copolymer P-co-X are together referred to herein as "propylene polymer" PP. The PP has a number average mol wt Mn in the range from about 10,000 to about 500,000, preferably about 30,000 to about 300,000 with a melt flow index from 0.1 to 30 g/10 min when measured according to ASTM D-1238.

To avoid the interaction of known antioxidants (AOs) with Red 144 pigment and/or the 3,5-DHPZNA, our stabilized PP fibers are preferably produced from a propylene polymer melt which has no more than 0.1 phr each of a hindered phenol AO, and a phosphite, as secondary, specifically melt stabilizers.

Solely for the purpose of facilitating the melt extrusion of the propylene polymer, a metal stearate such as calcium or zinc stearate in an amount insufficient to deleteriously affect the color of the fibers, preferably in the range from about 100 ppm to about 1500 ppm, and less than about 0.1 phr of a secondary stabilizer may be blended into the PP.

Since a predominant concern is the desired red color, only enough Red 144 pigment is added to the normally water white propylene polymer to produce the color, but no more than 2 phr.

The Red 144 pigment and 3,5-DHPZNA stabilizer may readily be incorporated into the PP by any conventional technique at a convenient stage prior to the melt extrusion of the PP fibers. For example, the pigment and stabilizer may be mixed with the PP in dry powder form, or a suspension or emulsion of the stabilizer may be mixed with a solution, suspension, or emulsion of the polymer.

The preferred Red 144-pigmented, 3,5-DHPZNA-stabilized, PP has so small an amount of antioxidant added to it, no more than 0.1 phr of an AO, that it does not make a sufficiently noticeable adverse contribution towards negative interaction upon exposure to sunlight, and is tolerable. Such a small amount of AO may be present in commercially available AO-free PP fibers, added thereto for process stability to facilitate its manufacture. Additives other than an AO, may be added if it is known they do not adversely affect the desired color, or help degrade the physical properties of the PP fibers when exposed to sunlight. Such additives may include lubricants in addition to alkaline earth metal stearates, near-colorless or white fillers such as glass fibers or talc, and optical brighteners.

Articles made of Red 144-pigmented, stabilized PP fibers, once placed in service, are likely to be used for several years but are not likely to be exposed continuously to 12 months of bright sunshine at 45° South (exposure). When noticeable fading of the pigment does eventually occur, the article has provided so large a proportion of its useful life that its color degradation is not objectionable.

In the comparative tests made and recorded in the following FIGS. 1–3, color change is measured according to the Standard Method for Calculation of Color Differences from Instrumentally Measured Color Coordinates, ASTM D 2244-85. The change in color measured in this manner does not reflect the peach-skin appearance due to broken fibers of degraded yarn. The useful life of the fabric is terminated when its surface becomes fuzzy as a peaches'. Visual inspection under an optical microscope shows that individual fibers in the matrix of the yarn are broken.

Polymer degradation is measured qualitatively by placing a sample of fabric under a low power optical microscope and scraping the surface of the yarn with a blunt spatula. When fibers are readily broken while the yarn is being scraped, the fabric has been degraded even if the color change is acceptably low.

Figure 1:
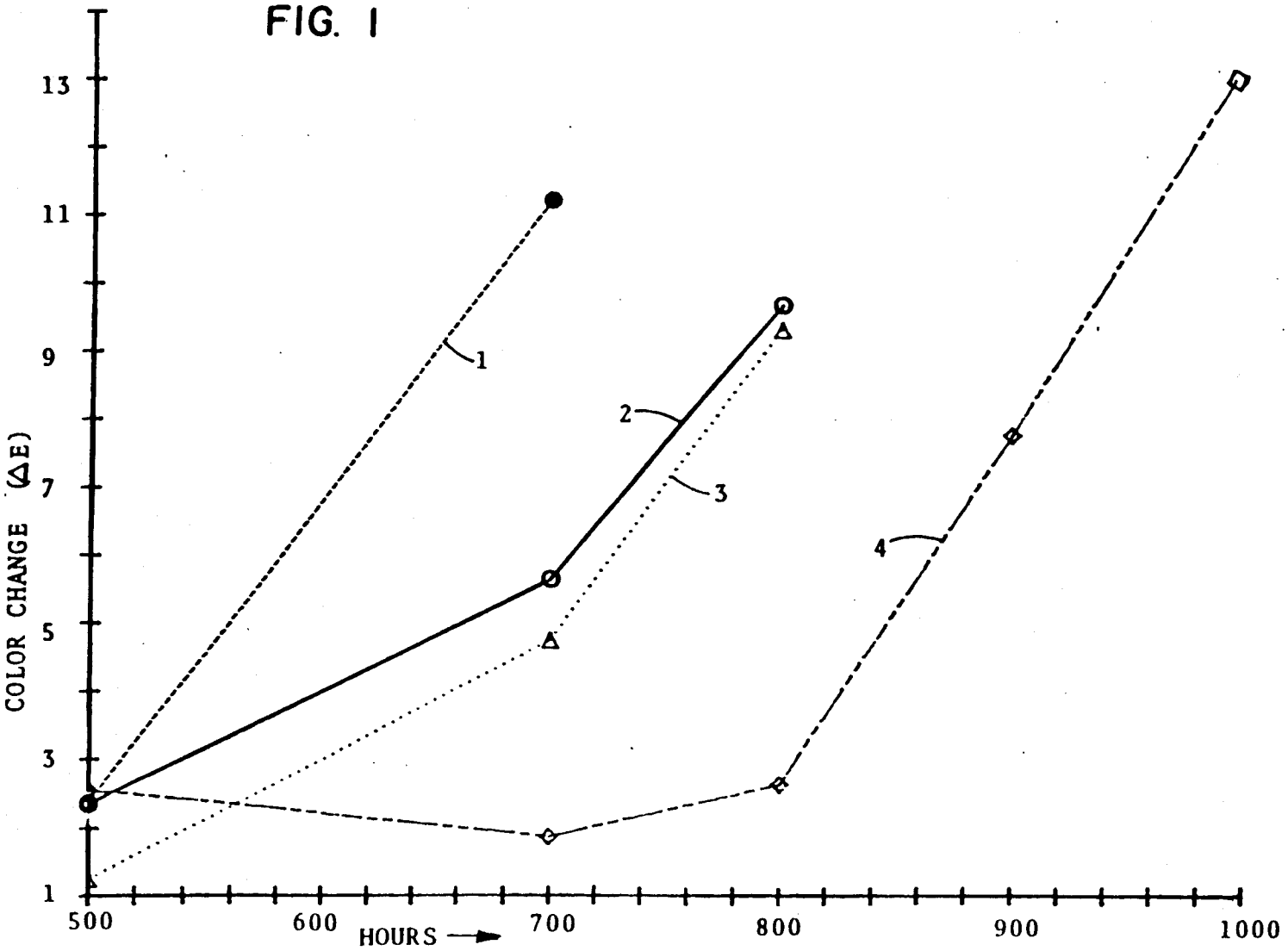
FIG. 1 presents data on the fading of a fabric made of Red 144-pigmented PP fibers, in four curves, one for each of four stabilizers. The curves show the fading of the fabric as change in color (delta E) plotted as a function of time in a Weather-O-Meter.

FIG. 1 presents four curves, one for each of four stabilizers, in which curves the change in color (delta E) is plotted as a function of time in a Xenon Weather-O-Meter, for Red 144-pigmented PP fibers containing 0.75 phr of Red 144, and 0.4 phr of a HALS in each sample. The Weather-O-Meter tests are conducted as described in ASTM G-77, Method A, using 2 hr exposure cycles in which the fabric samples are exposed to light for 102 min, followed by 18 min of light with a water spray. The black panel temperature is 63° C.

In FIG. 1, the color change is plotted as a function of time to record the fading of Red 144-pigmented fabric during the accelerated aging for samples containing each of the four stabilizers compared. The curve identified by reference numeral 1 is for fiber stabilized with 0.4 phr Cyasorb UV 3346; curve 2, for Chimassorb 944; curve 3, for Tinuvin 144; curve 4 for Goodrite ®X-146. Tinuvin 144 contains one or more hindered piperidinyl groups, and, in Chimassorb 944 and Cyassorb UV-3346 the piperidinyl groups are associated with triazine rings. It is evident that there is essentially no color change (ignoring the slight decrease shown as being attributable to a slight darkening) for the X-146 stabilized fabric, and that this is a unique result-effective property attributable to X-146.

The curve for each sample terminates at at the point in time when it was found that it had a peach fuzz appearance, or, scraping the fabric with the spatula destroyed the fabric. Tests for surface-shedding showed a high level of surface-shedding at the point where the fabric failed. There is essentially no fuzzy peach-skin appearance on the X-146 sample until 980 hrs.

Figure 2:
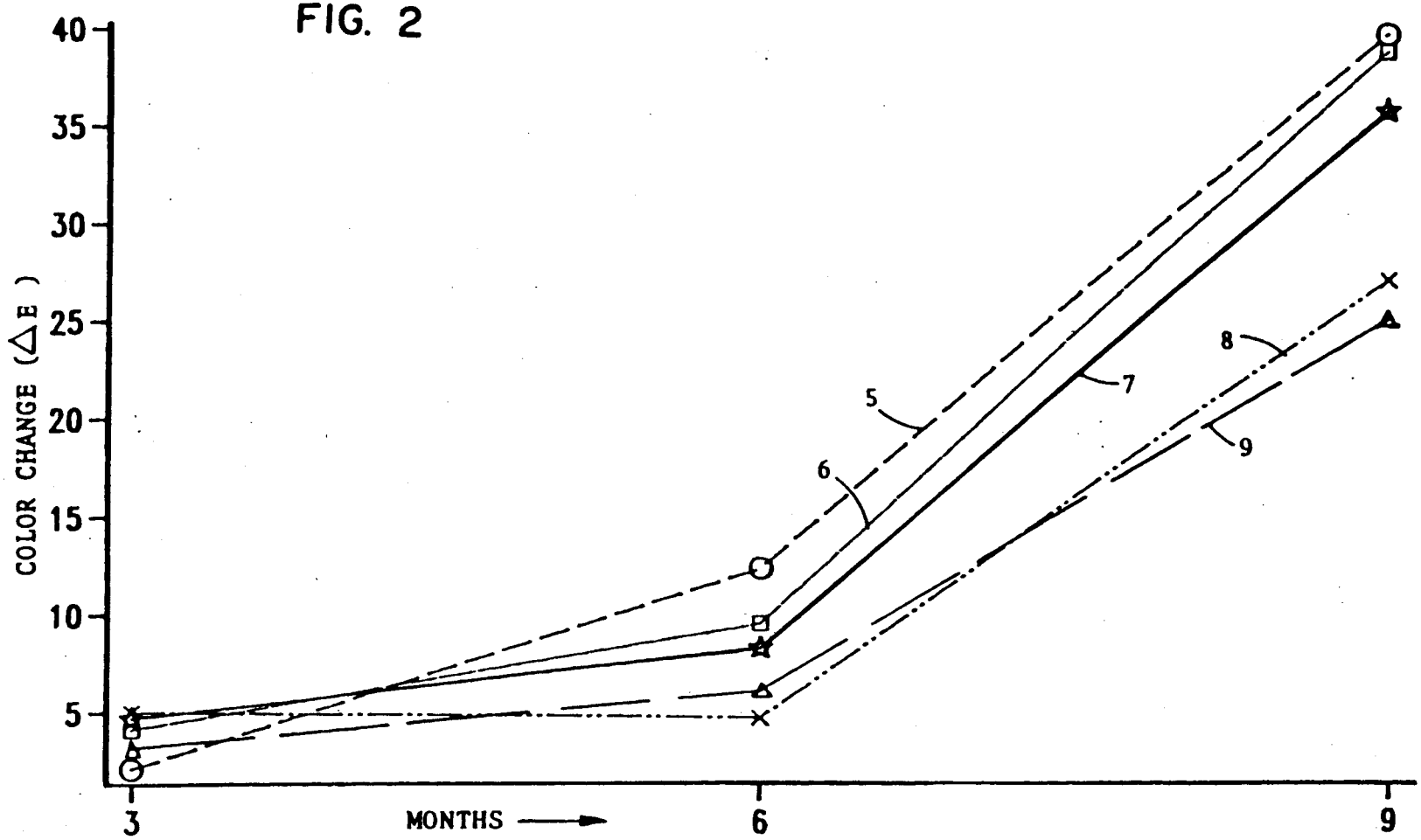
FIG. 2 presents five curves, one of which is for X-146 with no secondary stabilizer. The curves present data for the fading of a fabric made of Red 144-pigmented PP fibers containing HALS with no more than 0.1 phr of a melt stabilizing antioxidant. The curves show fading upon exposure to direct Florida sun.

FIG. 2 presents five curves, one of which is for X-146 with no secondary stabilizer. The other curves are for Red 144-pigmented PP fibers containing HALS with 0.1 phr of Goodrite ® 3114 and 0.08 phr Ultranox 626 for process stabilization. The curve identified by reference numeral 5 is for fiber stabilized with 0.4 phr Cyasorb UV 3346; curve 6, for Chimassorb 944; curve 7, for Tinuvin 144; curve 8 for Goodrite X-146; curve 9 for Godrite X-146 with no secondary stabilizer. Each curve represents the color change (delta E) as a function of time (nine months) during which the fibers were exposed to the direct rays of the Florida sun, at an angle of 45° S. The same amount of secondary stabilizer is present in each fabric sample, in combination with various HALS, each HALS present in the amount 0.4 phr. The fifth curve presents data for PP fibers containing 0.4 phr of a 3,5-DHPZNA (X-146), with no hindered phenol or other secondary stabilizer.

Referring to FIG. 2, it is evident that after 3 months of exposure to direct sunlight, the color change with X-146 is about the same as that with Tinuvin 144, and Chimassorb 944, but the color change for X-146 does not increase during the following three months, while the color change increases for the other stabilizers. As in the set exposed under glass, the color change with each stabilizer is greatest during the subsequent three month period, but after 9 months the test was stopped because all the samples showed unacceptable degradation of the fibers, and, because a color difference of 20 points is very large, easily noticeable at a distance, and highly objectionable.

Figure 3:
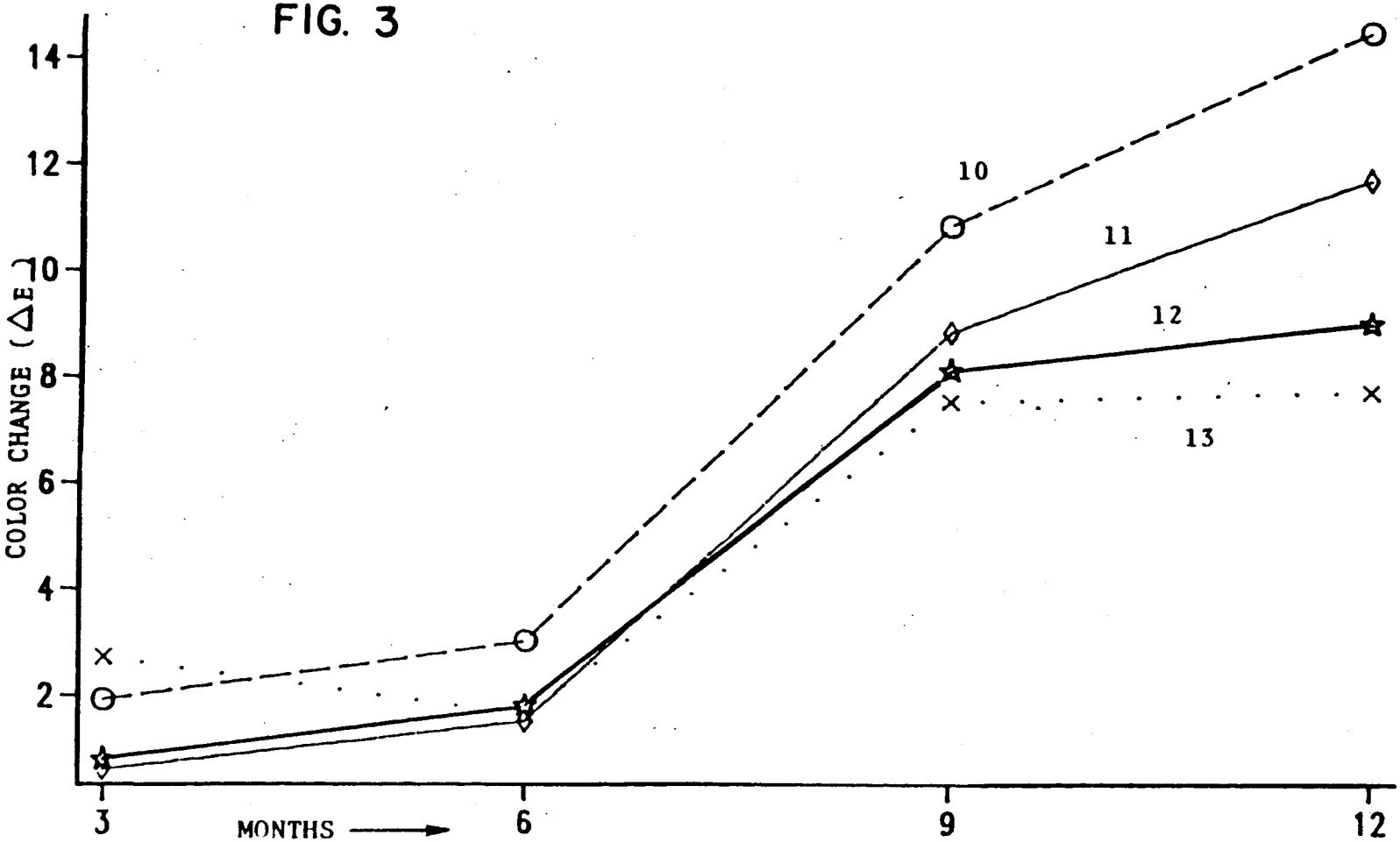
FIG. 3 presents four curves, one for each of four HALS. The curves present data for the fading of a fabric made of Red 144-pigmented PP fibers containing HALS with no more than 0.1 phr each of a melt stabilizing antioxidant, and a phosphite stabilizer, but under glass in the Florida sun.

FIG. 3 is a graph in which the color change (delta E) is plotted as a function of time during which the fibers were exposed under a sheet of clear glass to the rays of the Florida sun, at an angle of 45° S. Exposure under glass simulates exposure of fabric within a typical automobile exposed to direct sunlight, with the automobiles's windows closed.

Referring to FIG. 3, the curve identified by reference numeral 10 is for fiber stabilized with 0.4 phr Cyasorb UV 3346; curve 11, for Chimassorb 944; curve 12, for Tinuvin 144; and curve 13 for Goodrite X-146. It is seen that after 3 months of exposure under glass the color change is greatest in X-146, though not substantially greater than the others, but the change actually decreases during the following three months, while the color change increases for the other stabilizers. For each stabilizer, the color change is greatest during the subsequent three month period, but after 9 months, the fabrics still do not show a large color change. However, at the end of a year, the fabrics were unacceptably degraded. At that time, it is seen that the color change of about 14 for Cyasorb UV-3346 is about twice that obtained with X-146, which is about 7; the curves 11 and 12 lie in between. A color change of 5 is easily noticeable to the naked eye when it is compared side-by-side with the original color of the fabric, and a color change greater than 5 is generally deemed objectionable.

FIG. 4 graphically presents data obtained in a Weather-O-Meter in the presence of a water spray, in a graph in which the color change (delta E) is plotted as a function of time for PP fibers containing stabilizers as follows: (i) curve 14, for PP fibers with a HALS (identified as Goodrite X-141) disclosed in U.S. Pat. No. 4,547,538; (ii) curve identified by reference numeral 15 is for PP fibers with a hindered phenol (commercially available as Goodrite X-144); and (iii) curve 16, for PP fibers with Goodrite X-146; each stabilizer present in the amount of 0.4 phr.

Goodrite X-141 is represented by the structure

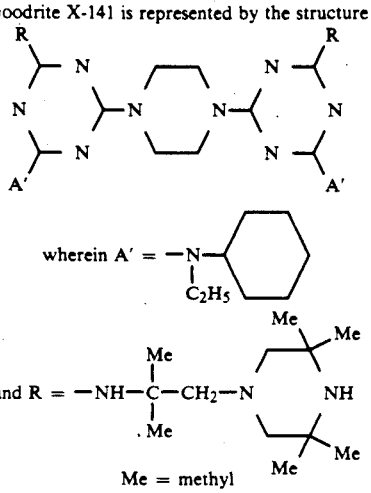

Goodrite X-144 is represented by the structure

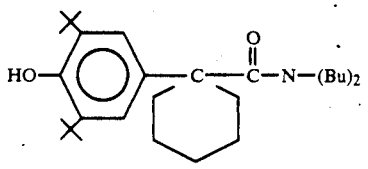

Thus it is seen that a compound with the disubstituted alpha C atom (alpha to the triazine ring), and having the substituted piperazin-2-one (in X-141) is not as effective as X-146; nor is a compound having the disubstituted alpha C atom (alpha to the hydroxyphenyl ring) in the substituted acetamide (in X-144) which does not have a substituted piperazin-2-one group.

PROCEDURE

Woven fabrics of PP fiber containing 0.4 phr of Red 144 pigment and 0.75 phr of a stabilizer, were exposed to the conditions of heat and light for which conditions the comparative tests are to be made.

It was observed that, before exposure, all samples of fabric were uniformly bright red. Immediately after irradiation, there is a distinct change in color, and the change in color is in the same portion of the spectrum for each sample.

We claim:

1. A method for imparting improved discoloration resistance to fibers of polypropylene homopolymer, or copolymers of propylene with a minor amount of ethylene, which method comprises incorporating into a melt from which said fibers are drawn, no more than a melt-stabilizing quantity of a secondary stabilizer, and an effective amount, sufficient to color the fibers bright red but less than 2 phr, of Red 144 azo condensation pigment so as to produce Red 144-pigmented fibers, and an effective amount, sufficient to attenuate degradation of said Red 144-pigmented fibers when exposed to sunlight, of a N-(substituted)-1-(piperazine-2-one alkyl)-α-(3,5-dialkyl-4-hydroxyphenyl)-α,α-substituted acetamide ("3,5-DHPZNA") having a disubstituted alpha carbon atom, said 3,5-DHPZNA having the structure

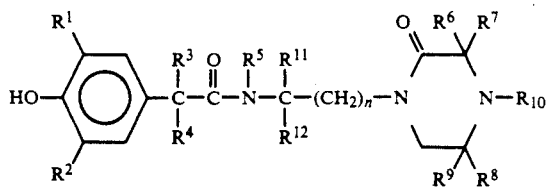

wherein, $R^1$, $R^2$ and $R^5$ each represent hydrogen, $C_1$–$C_{12}$ alkyl, phenyl, naphthyl, $C_4$-$C_{12}$ cycloalkyl, and, alkylsubstituted cycloalkyl, phenyl and naphthyl, each alkyl substituent being $C_1$–$C_8$, and at least one of $R^1$ and $R^2$ is t-$C_4$–$C_{12}$ alkyl;

$R^3$ and $R^4$ independently represent $C_1$–$C_{18}$ alkyl, and $C_5$–$C_{12}$ cycloalkyl, phenyl and naphthyl, and, alkyl-substituted cycloalkyl, phenyl and naphthyl, each alkyl substituent being $C_1$–$C_8$, and, when together cyclized, $R^3$ with $R^4$ may represent $C_4$–$C_{12}$ cycloalkyl, and $C_1$–$C_8$ alkyl-substituted cycloalkyl;

$R^6$, $R^7$, $R^8$ and $R^9$ each represent $C_1$–$C_{12}$ alkyl, or, when together cyclized, $R^6$ with $R^7$, and $R^8$ with $R^9$, may represent $C_4$-$C_{12}$ cycloalkyl, and $C_1$–$C_8$ alkyl-substituted cycloalkyl;

$R^{10}$ is selected from the group consisting of hydrogen, $C_1$–$C_8$ alkyl and

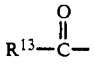

wherein $R^{13}$ represents hydrogen, $C_1$–$C_{18}$ alkyl or allenyl, phenyl or naphthyl;

$R^{11}$ and $R^{12}$ independently represent hydrogen and $C_1$–$C_{18}$ alkyl; and, n is an integer in the range from 1 to about 8.

2. The method of claim 1 comprising exposing said Red-144 pigmented fibers to bright direct sunlight for a period of 6 months; and, said 3,5-DHPZNA is specified by, n being 2 or 3;

$R^1$ being $C_1$–$C_8$ alkyl, $R^2$ is $C_1$–$C_5$ alkyl, $R^3$ and $R^4$ are each $C_1$–$C_8$ alkyl, and together, when cyclized represent cyclohexyl, methylcyclohexyl, cycloheptyl;

$R^5$ being $C_1$–$C_8$ alkyl; and, $R^{10}$ being hydrogen or $C_1$–$C_8$ alkyl.

3. The method of claim 2 wherein said 3,5-DHPZNA is specified by, at least one of $R^1$ and $R^2$ being t-butyl, or t-amyl; and, $R^3$ and $R^4$ being each $C_1$–$C_4$ alkyl.

4. The method of claim 2 wherein said 3,5-DHPZNA stabilizer is selected from the group consisting of (1) N-isopropyl-N-[2-(2-keto-3,3,5,5-tetramethyl-1-piperazinyl)ethyl]-2-(3,5-di-t-butyl-4-hydroxyphenyl)-2-methyl-propanamide;

(2) N-[1-(2-keto-3,3,5,5-tetramethyl-1-piperazinyl-2-methyl-2-propyl]-2-(3,5-di-t-butyl-4-hydroxyphenyl)-2-methyl-propanamide;

(3) N-[1-(2-keto-3,5,5-trimethyl-3-ethyl-1-piperazinyl-2-methyl-2-propyl]-2-(3,5-di-t-butyl-4-hydroxyphenyl)-2-methyl-butanamide;

(4) N-[1-(2-keto-3,3-pentamethylene-5,5-dimethyl-1-piperazinyl)-2-methyl-2-propyl]-2-(3,5-di-t-butyl-4-hydroxyphenyl)-2,2-pentamethylene acetamide;

(5) N-[1-(2-keto-3,3,5,5-tetramethyl-1-piperazinyl-2-methyl 2-propyl]-2-(3,5-di-t-butyl-4-hydroxyphenyl)-2,2-pentamethylene acetamide;

(6) N-cyclohexyl-N-[2-(2-keto-3,3,5,5-tetramethyl-1-piper-azinyl ethyl]-2-(3,5-di-t-butyl-4-hydroxy-phenyl)-2,2-pentamethylene acetamide;

(7) N-cyclohexyl-N-[3-(2-keto-3,3,5,5-tetramethyl-1-piperazinyl propyl]-2-(3,5-di-t-butyl-4-hydroxy-phenyl)-2,2-pentamethylene acetamide;

(8) N-cyclohexyl-N-[3-(2-keto-3,3,5,5-tetramethyl-1-piperazinyl-propyl]-2-(3,5-di-t-butyl-4-hydroxy-phenyl)-2-methyl propanamide; and, (9) N-cyclohexyl-N-[3-(2-keto-3,3,5,5-tetramethyl-1-piperazinyl-propyl]-2-(3,5-di-t-butyl-4-hydroxy-phenyl)-2-methyl butanamide.

* * * * *